US006921319B2

(12) United States Patent
Knoll et al.

(10) Patent No.: US 6,921,319 B2
(45) Date of Patent: Jul. 26, 2005

(54) METHOD FOR GRINDING A RAIL, AND DEVICE FOR CARRYING OUT SAID METHOD

(75) Inventors: Johann Knoll, Schörfling (AT); Walter Neubauer, Ohlsdorf (AT)

(73) Assignee: Linsinger Maschinenbau Gesellschaft m.b.H., Steyrermühl (AU)

( * ) Notice: Subject to any disclaimer, the term of this patent is extended or adjusted under 35 U.S.C. 154(b) by 63 days.

(21) Appl. No.: 10/346,057

(22) Filed: Jan. 17, 2003

(65) Prior Publication Data

US 2003/0143928 A1 Jul. 31, 2003

Related U.S. Application Data

(63) Continuation of application No. PCT/AT01/00233, filed on Jul. 12, 2001.

(30) Foreign Application Priority Data

Jul. 17, 2000 (AT) ..... A 1242/2000

(51) Int. Cl.[7] ..... B24B 1/00; B24B 27/08
(52) U.S. Cl. ..... 451/56; 451/58; 451/347
(58) Field of Search ..... 451/56, 57, 58, 451/178, 182, 347

(56) References Cited

U.S. PATENT DOCUMENTS

| | | | | |
|---|---|---|---|---|
| 4,583,327 A | | 4/1986 | Jaeggi | |
| 4,908,993 A | * | 3/1990 | Buhler | 451/347 |
| 4,951,424 A | | 8/1990 | Buhler | |
| 5,265,379 A | * | 11/1993 | Panetti | 451/11 |
| 5,566,437 A | | 10/1996 | Jaeggi | |
| 5,580,299 A | * | 12/1996 | Pomikacsek | 451/28 |

FOREIGN PATENT DOCUMENTS

| | | |
|---|---|---|
| DE | 44 37 585 | 3/1996 |
| EP | 0 843 043 | 5/1998 |
| WO | WO 91/17310 | 11/1991 |

* cited by examiner

*Primary Examiner*—Timothy V. Eley
(74) *Attorney, Agent, or Firm*—Dickstein Shapiro Morin & Oshinsky LLP

(57) ABSTRACT

The invention relates to a method for grinding at least the running surface of a rail (1), especially of a railway rail, by producing a relative movement between a grinding wheel (12) having a profile that mates the profile of the running surface, and a rail (1) in the longitudinal direction thereof. The aim of the invention is to avoid an overheating when large amounts of material are removed. To this end, the axis (21) of the grinding wheel (12) includes, with a plane (22) that is perpendicular to the longitudinal direction of the rail (1), an angle α that deviates from 0°.

33 Claims, 4 Drawing Sheets

1
2
3
7
8
9
10
11
12
13
14
15
16
17
18
19
20
21
22
23
24
II
α

METHOD FOR GRINDING A RAIL, AND DEVICE FOR CARRYING OUT SAID METHOD

This application is a continuation of international application number PCT/AT01/00233, filed Jul. 12, 2001.

The invention relates to a method for grinding at least the running surface of a rail, especially of a railway rail, by producing a relative motion between a grinding wheel having a profile that mates the profile of the running surface, and a rail in the longitudinal direction thereof, as well as a device for carrying out said method.

It is known to use cup wheels for grinding the convex cross-profile of a rail such as a railway rail, which cross-profile exhibits the running surface. However, in doing so, it only is possible to grind a narrow track in one passage so that a plurality of passages of the grinding wheel across the rail have to be carried out. That plurality of passages causes inaccuracies, since it is not possible to exactly orient the track produced during each passage according to the track that was previously ground. In addition to that, a large noise disturbance and, when it is dry, a risk of fire caused by flying sparks emerge.

Furthermore, it is known to machine the convex cross-profile of the rail head, which cross-profile exhibits the running surface, by means of front grinding wheels, whereby the grinding wheel has the desired profile of the rail head and is oriented such that its axis is perpendicular to the longitudinal plane of symmetry of the rail. However, that involves the disadvantage that any removal of material by grinding near the side regions of the rail head, i.e. near the guiding surface, is possible only to a limited extent, since, at that point, the grinding wheel enables only an unfavourable engagement angle of the abrasive grains, which leads to the drawback of an overheating of the rail material. Should one wish to eliminate said drawback, one is forced to reduce the amount of removed material per unit of time, which in turn, however, requires a plurality of passages or grinding operations, respectively, for one and the same region of the rail to be ground.

The invention aims at avoiding those drawbacks and difficulties and has as its object to provide a grinding method of the initially described kind, which, on the one hand, enables a removal of material in one passage for the entire cross section to be ground, which removal is sufficient for rails, and which, on the other hand, prevents an overheating of the rail material. Furthermore, the grinding wheel should have a sufficiently long service life despite its great efficiency, i.e., despite the large length of rail which is ground per unit of time.

In accordance with the invention, that object is achieved in that the axis of the grinding wheel and a plane perpendicular to the longitudinal direction of the rail include an angle $\alpha$ deviating from 0°.

Preferred embodiments are characterized in greater detail in the subordinate claims.

A device for carrying out the method has the following characteristic features:

- a means for generating a relative motion between the rail and the grinding wheel,
- a driving means for the grinding wheel, and
- a positioning of the axis of the grinding wheel in a direction deviating from a plane perpendicular to the longitudinal direction of the rail.

Preferred embodiments of the device are contained in the subordinate claims 24 to 33.

In the following, the invention is explained in more detail by way of two exemplary embodiments with reference to the drawing, wherein FIG. 1 shows a side view of a device for carrying out the method according to the invention and FIG. 2 shows a schematic top view along the arrow II of FIG. 1.

Figure 4:
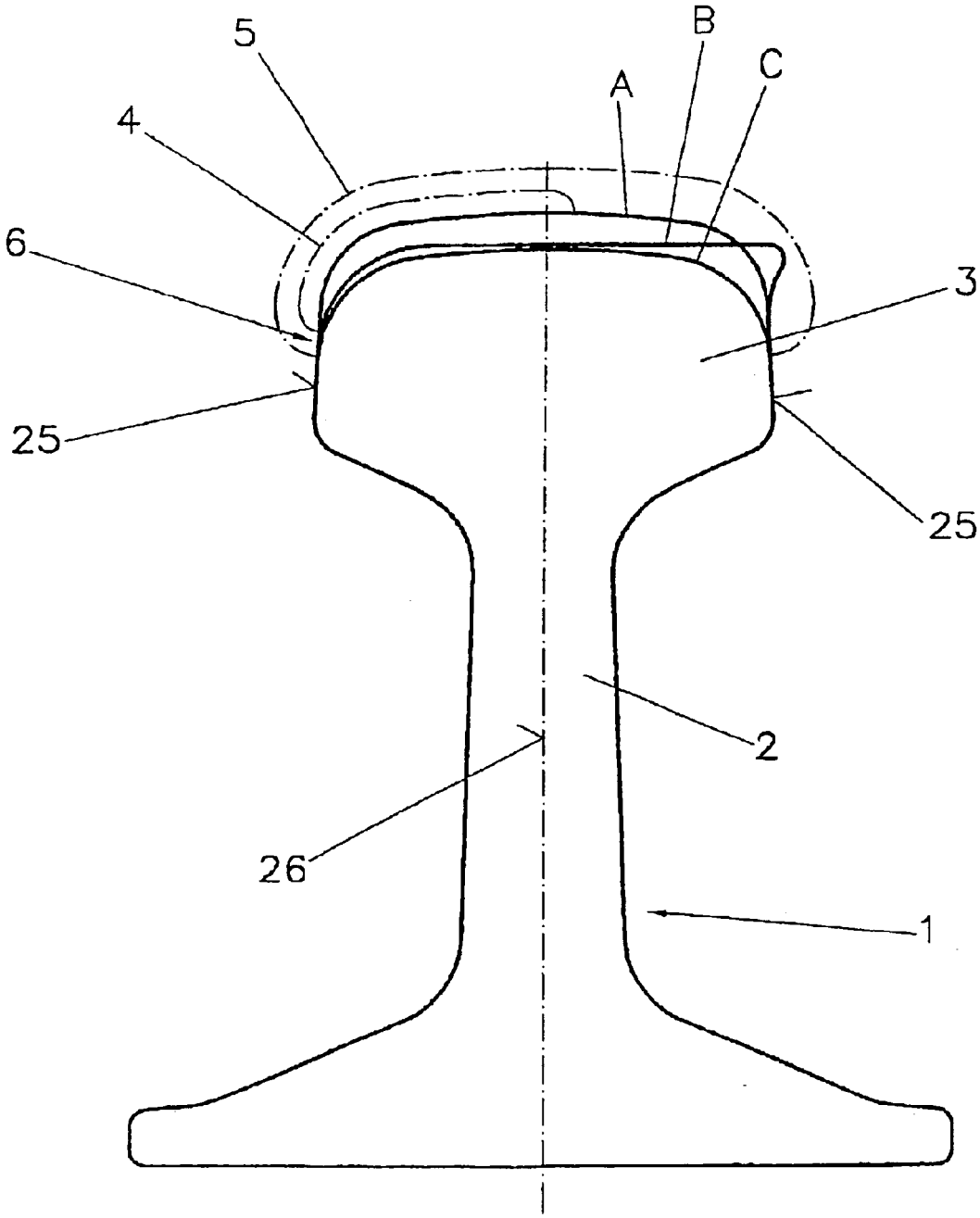
FIG. 4 shows the cross section of a railway rail in various conditions of the rail.

In FIG. 4, the cross section of a rail 1 is illustrated in various conditions. The rail head 3 situated on the stem of a rail 2 is provided with a convex cross-sectional portion 5 exhibiting the running surface 4 on which the track wheel of a rail vehicle runs, which cross-sectional portion, in its new condition, is illustrated by line A. Due to wear, that convex portion 5 of the cross section of the rail head 3 receives the shape as illustrated by line B. As soon as rail 1 has reached that condition or even earlier, as in accordance with high-speed rails, rail 1 is subjected to finishing so that the convex portion 5 of the rail head 3, at least, however, the running surface 4, regains its original condition, i.e. the original cross-sectional shape—as illustrated by line C—with the best possible approximation in accuracy. Thereby, certain tolerances in the range of from 1 to 3 decimillimeters are to be observed according to the regulations of a railway operator or a railway corporation or a supraregional standard such as cen DRAFT pr EN 13674-1. In doing so, it is essential that the guiding surface 6 of the rail 1 and the running surface 4 are finished.

In case of old rails having a worn rail-head profile, the rail-head profile is to be re-profiled, wherefore milling and grinding according to the invention are provided. In case of new rails, it is suitable to remove the roller skin in order to achieve better running qualities, a longer lifetime as well as a noise reduction; the grinding operation according to the invention without previous milling is sufficient for that purpose.

As can be seen in FIG. 4, a relatively large amount of material has to be removed according to the wear of the rail, which has to be done as fast and inexpensively as possible in case of laid rails so as to impede the railway traffic as little as possible.

Figures 1, 2:
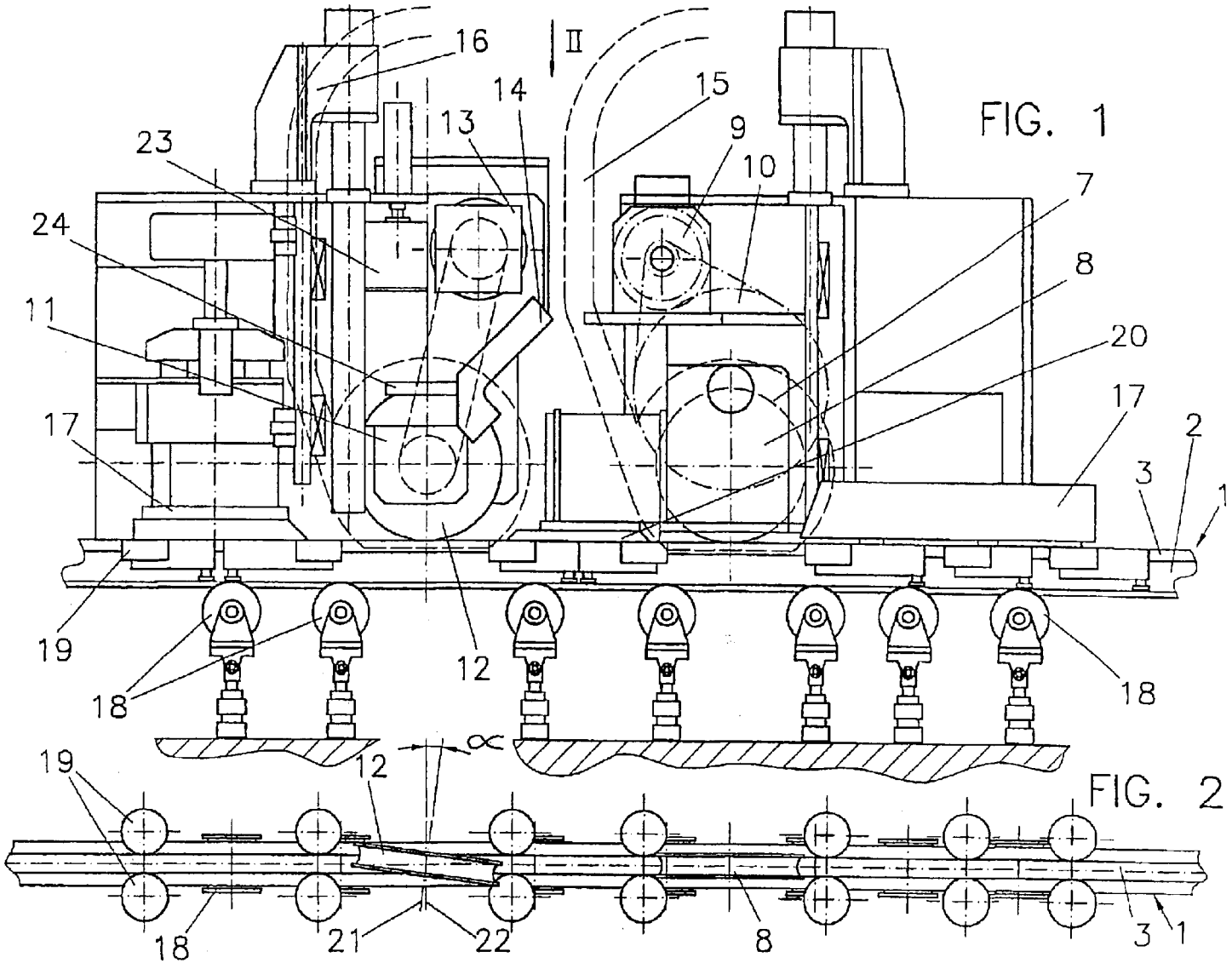
Figure 3:
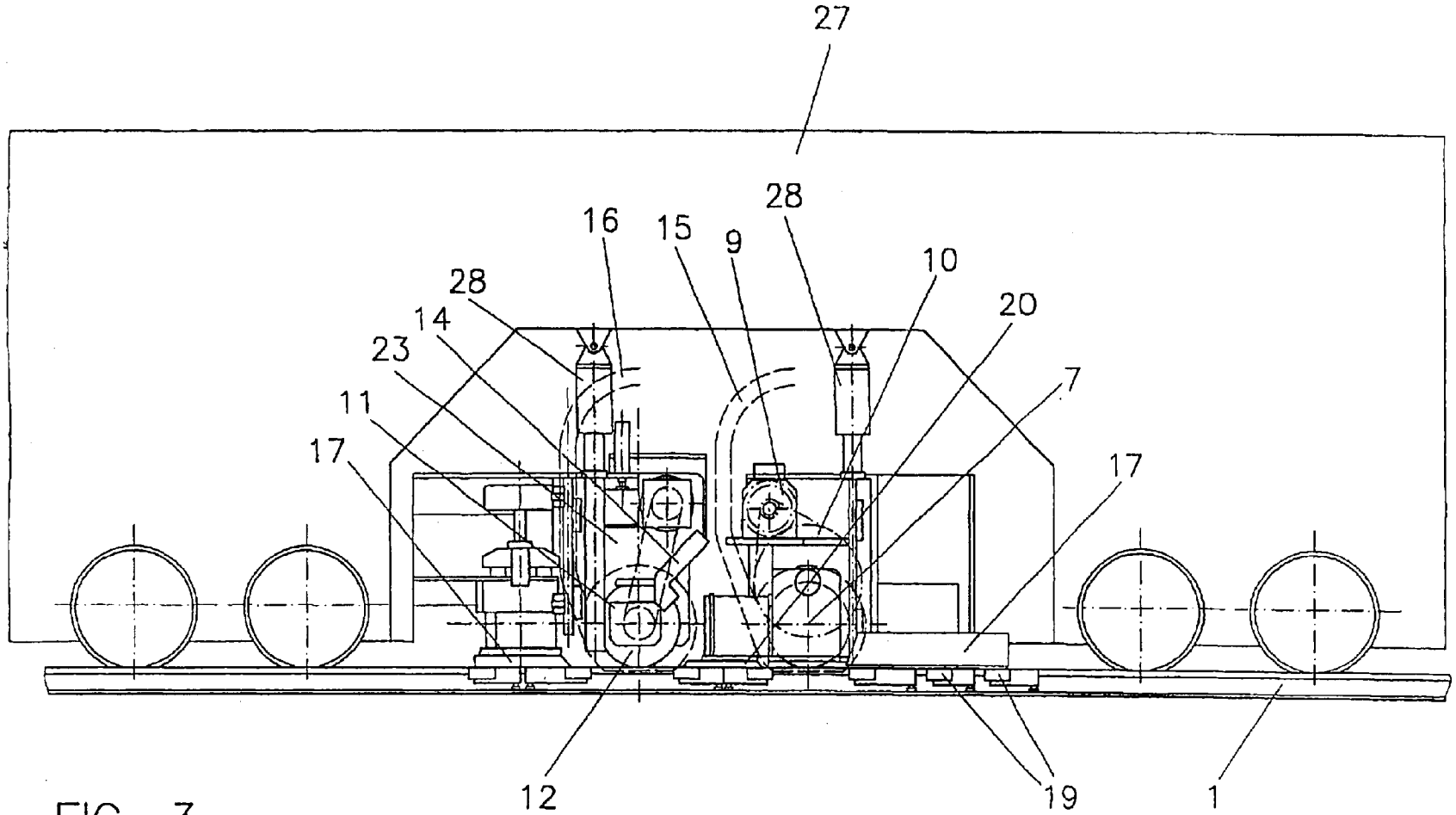
FIG. 3 shows a variant of the device for carrying out the method according to the invention.

FIGS. 1 and 2 illustrate a device according to the invention which is arranged in a stationary position and past which the rail 1 to be machined is moved. FIG. 3 illustrates a device according to the invention which is incorporated in a movable facility such as a locomotive engine so that it is feasible to machine rails which already have been laid by means of said device. In that case, the device according to the invention exists in duplicate so that both the left-hand and the right-hand rails can be finished in one passage. Parts and devices of the stationary facility and the movable device which are mutually identical are marked by identical numerals.

7 denotes a milling unit the milling cutter 8 of which is configured as a peripheral milling cutter. Said milling cutter 8 can be driven via a driving motor 9 and a gear 10 whereby the direction of rotation is chosen such that the rail 1 is machined by the cut-down milling method. Immediately adjacent to the milling unit 7, a grinding unit 11 is provided, the grinding wheel 12 of which can be driven by means of a driving gear 13, preferably also in the direction of rotation of the milling cutter 8 so that down-grinding of the rail 1 is effected. The grinding wheel 12 is equipped with a system for regulating the depth of grinding 14 so that it is feasible to continuously readjust the grinding wheel 12 to the rail 1, according to its wear. Said system for regulating the depth of grinding 14 comprises a measuring system for measuring the continuously decreasing diameter of the periphery of the grinding wheel 12; it can also make use of measuring data gained from measuring the moment of driving.

Just upon their emergence, both the milling chips and the grinding chips as well as the grinding dust are sucked off via the suction means 15 and 16.

Just in front of the milling unit 7 and just behind the grinding unit 11, guides 17 for the rail 1 are provided in each case, against which guides the rail 1 can be pressed by means of support rolls 18, whereby it is possible to press at least the running surface 4 of the rail 1, preferably the crown of the rail head 3. Furthermore, lateral guiding rolls 19 engaging the rail head 3 on both sides are provided along the device, whereby the lateral guiding rolls 19 fitting closely to the side of the guiding surface 6 of the rail 1 are fixed in their positions. The rail is pressed against the fixed lateral guiding rolls 19 by the lateral guiding rolls 19 fitting closely to the opposite side, whereby the rail 1 assumes an exact position opposite the milling unit and the grinding unit.

Between the milling unit 7 and the grinding unit 11, a further guide 20 is provided, which is equipped with a damping device in order to eliminate any vibrations of the rail 1 caused by the milling cutter.

As can be seen in particular in FIG. 2, the axis 21 of the grinding wheel is inclined by an angle $\alpha$ against a plane 22 perpendicular to the longitudinal direction of the rail, which angle is greater than 0, preferably ranging between 1 and 20° C., depending on the respective condition of the rail 1 prior to grinding. If the rail head 3 has a cross section which, due to milling, approaches the ideal cross section, already before grinding, or if the rail 1, in its new condition, is still provided with a roller skin, the angle $\alpha$ suitably ranges between 5 and 12°, ideally amounting to 8°. However, if the previous state of the cross section has been adjusted to the ideal cross-profile in a less exact manner, f.i., if it has been roughed down only crudely, a smaller angle $\alpha$, preferably ranging between 1 and 6° C., is suitable for securing an optimal chip removal volume with a long service life of the grinding wheel.

In its new condition, the grinding wheel 12 has already been pre-profiled, i.e., it exhibits a profile which roughly mates rail 1. For an exact manufacture of said counterprofile, it is advantageous to provide a sharpening means 23 with a grinding stone 24 which can be pressed against the periphery of the grinding wheel 12. Said grinding stone has exactly the desired profile which is to be produced and it also includes angle $\alpha$ together with the grinding wheel. Before grinding of the first rail 1 is started, said grinding stone 24 is pressed against the grinding wheel 12 until the grinding wheel has adopted its profile. While rail 1 is ground, the grinding stone 24 can be lifted from the grinding wheel 12, since the grinding wheel profiles itself at the pre-profile, i.e., at the milled rail-head area or the rail-head surface still provided with the roller skin, respectively. During machining of a rail head 3, the grinding stone may optionally be fitted to the grinding wheel 12 for temporary sharpening.

Rail 1 may also be used for the adjustment of a profile which exactly mates the grinding wheel 12 provided that it has been milled with sufficient accuracy or still has the roller skin.

If, as in the illustrated exemplary embodiment, a milled rail-head surface is ground, the profiled grinding wheel 12 only has the most important task of smoothing the waves generated by the milling cutter 8 and of creating an image of traverse grinding.

Figure 5:
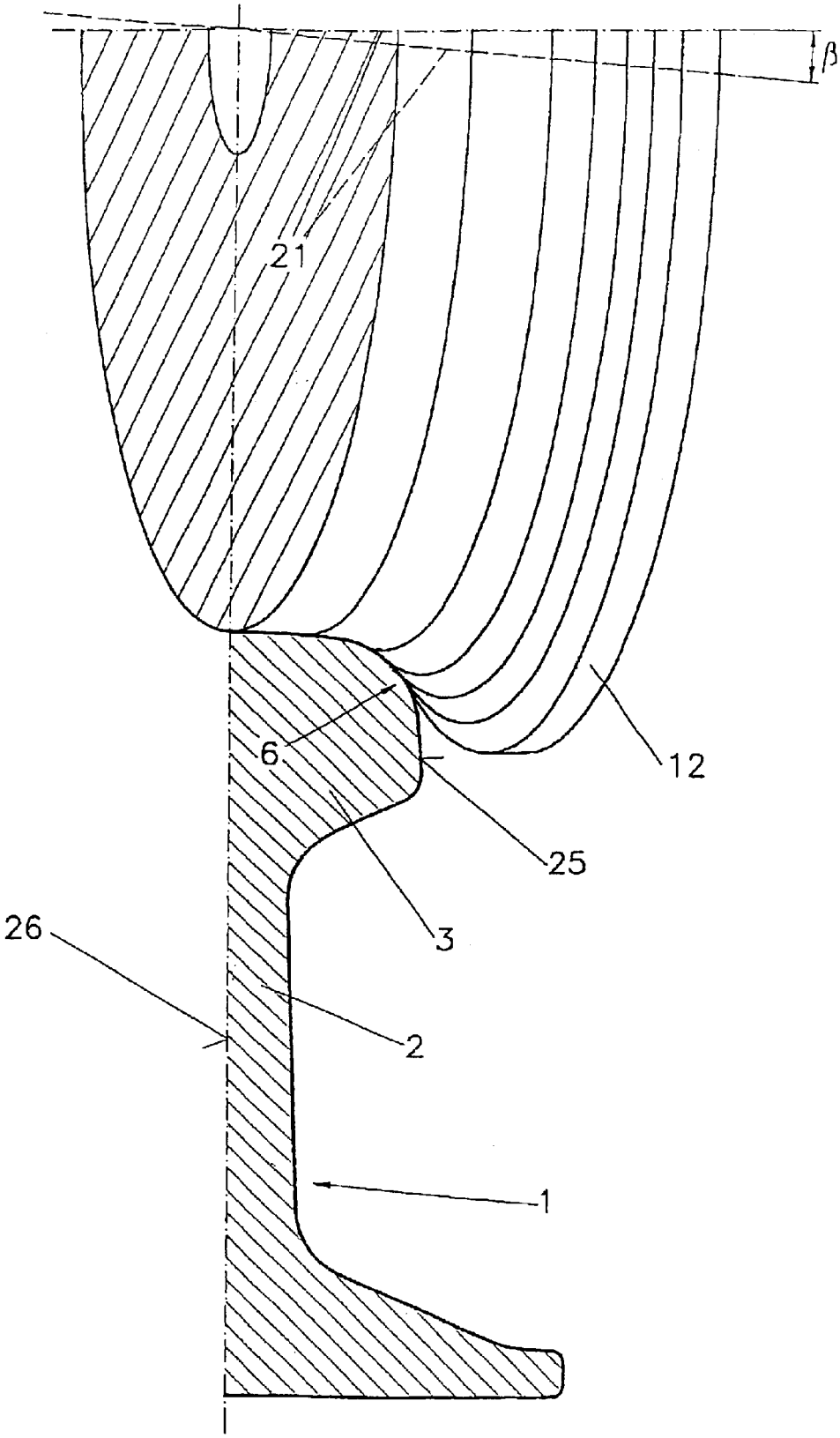
FIG. 5 shows the engagement of the grinding wheel on a railway rail seen in cross section, in accordance with the method according to the invention.

By inclining the grinding wheel 12 according to the invention, particularly good conditions of engagement as well as a strong smoothing effect occur. The engagement of the inclined grinding wheel 12 is illustrated in FIG. 5. It is apparent that the inclination creates an advantageous engagement angle, in particular at the point where the convex portion 5 of the rail head 3 meets the side faces 25 of the rail head 3. Those favourable conditions of engagement allow also in those places a sufficiently extensive removal of material with a very good thermal behaviour being provided so that, on the ground surface, burning cannot occur. Furthermore, a very good service life of the grinding wheel 12 is thereby created.

It can be advantageous if the axis 21 the grinding wheel 12 is also inclined against the rail's longitudinal central plane of symmetry 26 by an angle $\beta$ which may have a size of between 70° and 90°.

If different rail profiles are to be machined by means of the device according to the invention, the axis 21 of the grinding wheel 12 may suitably be arranged so as to be adjustable on the device.

According to the embodiment illustrated in FIG. 3, the milling unit 7 and the grinding unit 11 are incorporated in a rail-milling line 27. By means of actuators 28, the milling cutter 8 and the grinding wheel 12 are moved approximately vertically against the rail 1 until the guides 17 and 20 rest on the rail head 3. A lateral movement of the grinding unit 11 and the milling unit 7 toward the guiding surface 6 until the lateral guiding rolls 19 rest on the rail head 3 is possible as well.

What is claimed is:

1. A method for grinding the running surface (4) of a railway rail (1), by producing a relative motion between a grinding wheel (12) and the rail in the longitudinal direction thereof, the grinding wheel having a profile that mates with the profile of the running surface, and being driven by means of a motor (9), with the axis of the grinding wheel and a plane perpendicular to the longitudinal direction of the rail including an angle $\alpha$ deviating from 0°, the grinding wheel (12) being moved against the rail (1) up to the point of engagement, characterized in that, upon peripheral milling of the running surface, said movement of the grinding wheel (12) against the rail (1) is restricted by means of a guide (17) which can be pressed against the milled running surface (4) of the rail (1), independently of a system for regulating the depth of grinding, whereby, depending on the wear of the grinding wheel, the grinding (12) is automatically readjusted in the direction toward the rail (1) by regulating the depth of grinding.

2. A method according to claim 1, characterized in that rail (1) has a guiding surface (6), and the axis of the grinding wheel (12) is movable in the direction against the guiding surface (6) of the rail (1), which movement is restricted by means of a further guide (19) directed against the guiding surface (6) of the rail (1).

3. A method according to claim 1, characterized in that the axis (21) of the grinding wheel (12) and the plane perpendicular to the longitudinal direction of the rail (1) include an angle $\alpha$ of between 1 and 20°.

4. A method according to claim 3, characterized in that the angle $\alpha$ ranges between 5 and 12°, preferably amounting to about 8°.

5. A method according to claim 1, characterized in that the axis (21) of the grinding wheel (12), with a cutting line of a plane of symmetry lying in the longitudinal direction of the rail (1), and the plane directed so as to be perpendicular to the longitudinal direction of the rail (1) include an angle $\beta$ of about 90°.

6. A method according to claim 5, characterized in that the rail has a guiding surface (6), and the angle β is smaller than 90° and greater than 70°, with said angle β being maintained on the side of the guiding surface (6) of the rail (1).

7. A method according to claim 1, characterized in that a roller skin present of the running surface (4) of the rail (1) is removed by means of the grinding operation.

8. A method according to claim 1, characterized in that a milled surface, which is present of the running surface (4) prior to grinding, is removed at least partially by means of the grinding operation.

9. A method according to claim 1, characterized in that the the rail head has a convex cross-profile (5) which is ground in its entirety in addition to the running surface (4).

10. A method according to claim 1, characterized in that the driving wheel (12) has a moment of driving, and the depth of grinding is regulated by making use of measuring data gained from measuring the diameter of the grinding wheel surface or by making use of measuring data gained from measuring the moment of driving of the grinding wheel (12).

11. A method according to claim 5, characterized in that the grinding wheel (12) is profiled by means of a grinding stone (24), whereby the grinding stone (24) exhibits the profile of at least the running surface (4) of the rail (1) and its longitudinal direction, together with the grinding wheel (12), includes the same angle α and β as does the rail (1).

12. A method according to claim 11, characterized in that before grinding of the running surface (4) of the rail (1) is started and, subsequently, during grinding, profiling is carried out only optionally and at larger time intervals.

13. A method according to claim 1, characterized in that the relative motion between the rail (1) and the grinding wheel (12) is generated by longitudinally displacing the rail (1) relative to the grinding wheel (12).

14. A method according to claim 12, characterized in that, immediately before the engagement of the grinding wheel (12), the rail (1) is pressed against the guide, the guide being directed against the running surface (4) of the rail (1).

15. A method according to claim 14, characterized in that the guide (17) is damped in order to avoid vibrations.

16. A method according to claim 13, characterized in that, immediately before the engagement of the grinding wheel (12), the rail (1) is pressed against the guide, the guide being directed against the guiding surface (6) of the rail (1).

17. A method according to claim 16, characterized in that, immediately upon the engagement of the grinding wheel (12), the rail (1) is pressed against a further guide (17) directed toward the running surface (4) of the rail.

18. A method according to claim 13, characterized in that, immediately upon the engagement of the grinding wheel (12), the rail (1) is pressed against the guide, the guide comprising a lateral guide (19) directed against the guiding surface (6) of the rail (1).

19. A method according to claim 1, characterized in that, immediately upon their emergence, grinding chips are sucked off.

20. A method according to claim 1, characterized in that grinding is carried out by a cut-down method.

21. A method according to claim 1, characterized in that the relative motion between the rail (1) and the grinding wheel (12) is performed by longitudinally moving the grinding wheel (12) along a stationary rail (1).

22. A device for carrying out the method according to claim 1, characterized by:

a means for generating a relative motion between a rail (1) and a grinding wheel (12), a driving means (9) for the grinding wheel, a positioning of the axis (21) of the grinding wheel (12) in a direction deviating from a plane perpendicular to the longitudinal direction of the rail (1), a guide (17) which can be pressed against the running surface (4) of the rail (1), a system for regulating the depth of grinding (14) which is adjustable independently of the pressing of the guide (17), and a means for readjusting the grinding wheel (12) depending on the wear in the direction toward the rail (1), which means has a measuring system for evaluating the diameter of the grinding wheel.

23. A device according to claim 22, characterized in that the deviation a from the plane perpendicular to the longitudinal direction of the rail amounts to between 1 and 20°.

24. A device according to claim 23, characterized in that the deviation a amounts to from 5 to 12°, preferably to about 8°.

25. A device according to claim 23, characterized in that the positioning of the axis (21) of the grinding wheel (12) is displaceable from a plane perpendicular to the longitudinal direction of the rail (1) in order to adjust different deviations.

26. A device according to claim 22, characterized in that the positioning of the axis (21) of the grinding wheel (12) is configured such that the axis (21) of the grinding wheel (12), with a cutting line of a plane of symmetry lying in the longitudinal direction of the rail (1), and the plane directed so as to be perpendicular to the longitudinal direction of the rail (1) include an angle β of about 90°.

27. A device according to claim 22, characterized by a grinding stone (24) which has the profile of at least the running surface (4) of the rail (1) and is oriented in a longitudinal direction of which includes the same angle α and β against the grinding wheel (12) as does the rail (1).

28. A device according to claim 22, characterized by a means for moving a rail (1) past the grinding wheel (12) in the direction of the longitudinal axis of the rail.

29. A device according to claim 28, characterized in that the means comprises the guide (17) directed against a running surface (4) of the rail (1) and a pressing facility (18) for pressing the rail (1) against said guide (17).

30. A device according to claim 29, characterized in that the guide (17) is vibration-reduced.

31. A device according to claim 29, characterized in that a lateral guide (19) for the rail (1), which lateral guide is directed against the guiding surface (6) of the rail (1), as well as a pressing facility for pressing the rail against said lateral guide (19) are provided.

32. A device according to claim 22, characterized in that the grinding wheel (12) is provided on a traveling means displaceable along a laid rail.

33. A device according to claim 32, characterized in that the rail has a guiding surface (6), and the traveling means (27) includes the guide (17) and a further guide (19), the guides (17, 19) restricting the engagement of the grinding wheel (12) approximately vertically and approximately horizontally and engaging the rail (1) at the running surface (4) and at the guiding surface (6).

* * * * *